United States Patent [19]

Ladd et al.

[11] 3,948,524

[45] Apr. 6, 1976

[54] GAME APPARATUS

[75] Inventors: Robert B. Ladd, Bryantville; Harold F. Finizia, Roxbury, both of Mass.

[73] Assignee: Robert B. Ladd, Bryantville, Mass.

[22] Filed: Mar. 14, 1974

[21] Appl. No.: 450,973

[52] U.S. Cl. ..... 273/135 R; 273/130 F

[51] Int. Cl.[2] ..... A63F 3/00

[58] Field of Search..... 273/130 R, 130 F, 131 R, 273/131 BB, 131 K, 135 R, 135 AC, 135 AA, 135 AB, 131 KC

[56] References Cited

UNITED STATES PATENTS

| | | | |
|---|---|---|---|
| 1,519,422 | 12/1924 | Taylor | 273/135 R |
| 1,615,077 | 1/1927 | Gouldin | 273/130 F |
| 1,689,984 | 10/1928 | Walton | 273/130 F |
| 2,766,987 | 10/1956 | Seelbrede | 273/130 F |
| 2,901,255 | 8/1959 | Sutherland | 273/135 AA |

FOREIGN PATENTS OR APPLICATIONS

| | | | |
|---|---|---|---|
| 20,002 | 1914 | United Kingdom | 273/131 KC |
| 476,841 | 1937 | United Kingdom | 273/130 F |
| 426,416 | 1925 | Germany | 273/130 F |

*Primary Examiner*—Richard C. Pinkham
*Assistant Examiner*—Joseph R. Taylor
*Attorney, Agent, or Firm*—John A. Haug

[57] ABSTRACT

The game comprises a flat, generally square board divided into smaller squares, two classes of tokens for placement on the board including markers and bridges, and a deck of standard playing cards less queens, kings and jokers. The tokens are preferably colored so that the tokens of each of the game's players can be readily identified. The cards are used to determine the placement of the beginning tokens as well as the order of play throughout the game. During the game each player attempts to place his markers to enclose various areas on the board.

11 Claims, 3 Drawing Figures

GAME APPARATUS

BACKGROUND OF INVENTION

This invention relates to games and more particularly to games combining both chance and skill.

Over the years there has always been a great deal of interest in games to serve the needs of various people including whiling away time, as a means of relaxation, enjoyment and as a challenge. In recent years there has been a great resurgence of certain games such as bridge or chess in which skill is the dominant characteristic of the game. In such games the more skilled and talented players consistently beat their opponents. This tends to become tiresome for all the players since the outcome of the game is virtually preordained. On the other hand the dominant characteristic of many other games is chance such as is occasioned by the drawing of cards, the spin of a wheel or the fall of dice. These games become equally tiresome since the players have so little control over the outcome of the game.

Thus there is a need for many people for a game combining both chance and skill, chance so that the eventual outcome of the game is not a certainty and skill so that each player is able to consider the several variables of the game and have some personal choice to effect the outcome of the game.

It is therefore an object of the invention to provide a game which combines both chance and skill, a game which is easily understandable yet one in which interest in the game can easily be maintained even among people of varying skills and talents. Another object is the provision of a game which can be inexpensively produced so that it can be available to the great majority of people.

Other objects and features will be in part apparent and in part pointed out hereinafter.

The invention accordingly comprises the elements and combination of elements, features of construction and arrangement of parts, all of which will be exemplified in the structures hereinafter described, and the scope of the application of which will be indicated in the appended claims.

In the accompanying drawings, in which one of the various possible embodiments of the invention is illustrated:

Similar reference characters indicate corresponding parts throughout the several views of the drawings.

SUMMARY OF INVENTION

Figure 1:
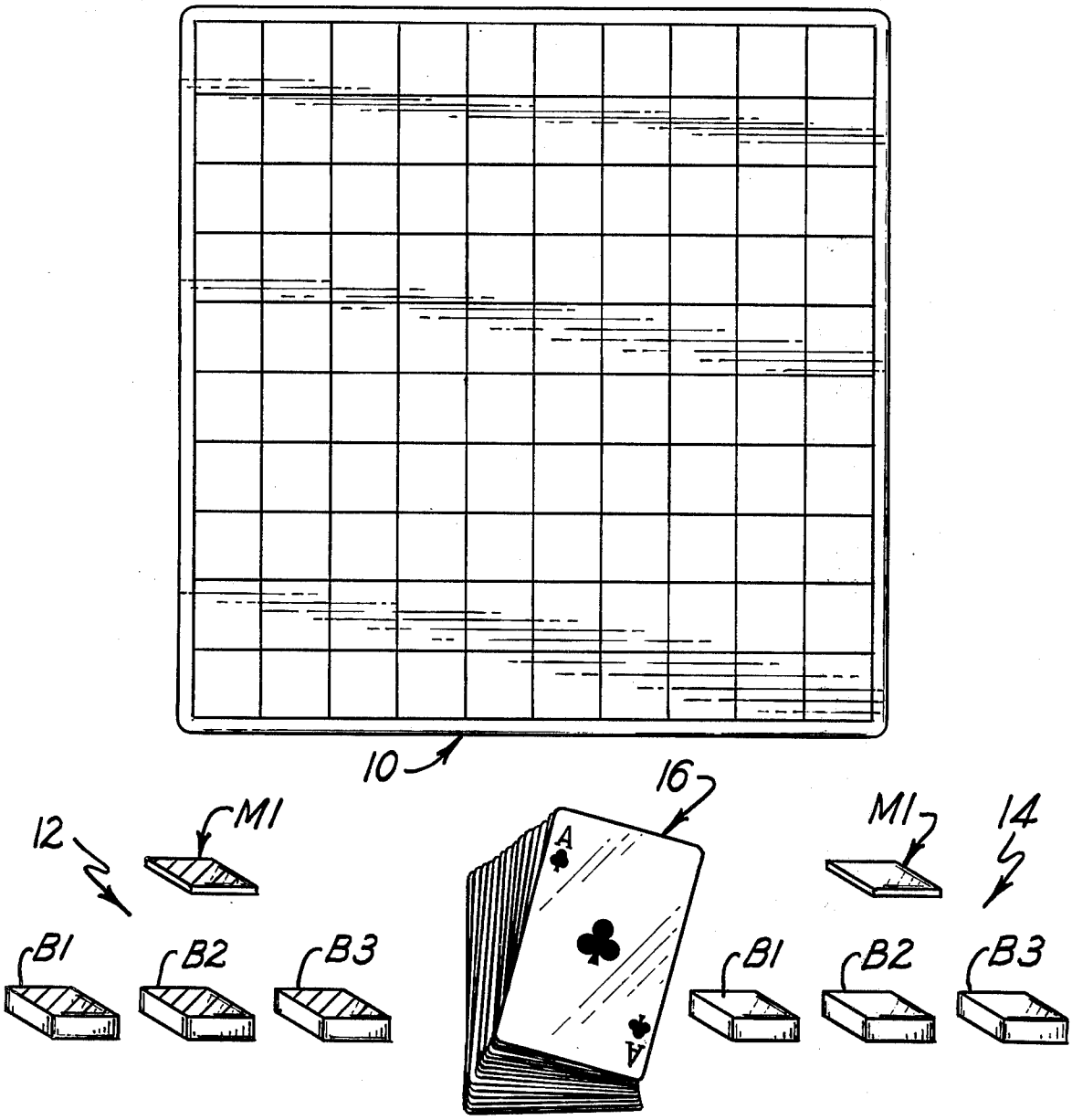
FIG. 1 depicts the component parts of the game including a gameboard useful in the present ivention, the beginning tokens for two players and a deck of cards.

Briefly the invention comprises a gameboard divided into squares, preferably 10 by 10, a plurality of tokens for each player and a deck of cards. The game is initiated by placement of beginning tokens for each player on the board as determined by the dealing of cards. After the beginning tokens are located the order of play is determined by dealing of cards, one at a time but the placement of the tokens is determined by the player. Each player attempts to enclose or capture areas of the board and in so doing compile a higher point total than the opposing players.

The following description of the game will be made as applicable to two players. With reference to the drawings, the gameboard is generally indicated by reference numeral 10. Preferably board 10 is generally square and is divided into one hundred smaller squares. A plurality of tokens 12 and 14 are provided for each player. A deck of cards 16 is used to determine the placement of the beginning tokens and thereafter to determine the order of play of the two players.

Tokens of each player are made up of two classes, markers and bridges. The function of these tokens will be described below. The beginning tokens for each player as seen in FIG. 1 consist of a starting marked, M1 and three bridges, B1, B2 and B3. The remaining tokens used during a game consist of additional markers. During the game the players place their markers on vacant squares, one to a square, in an attempt to enclose bridges located on the board as well as to enclose as large an area as possible. Each square enclosed, including the boundary squares is counted as a point while each enclosed bridge is counted as an additional five points. Markers must be placed in chain fashion emanating from the starting marker, however they can be placed in any direction, vertical, horizontal or diagonal with a maximum of three consecutive squares in any give direction (not including the starting marker). Once the direction is changed, markers can again be placed in the same direction for another three consecutive squares if desired.

A bridge can be passed by markers of the same player in the same direction it is approached, however if the bridge forms a part of the boundary and is not completely enclosed it is only worth one point to the player.

Figure 2:
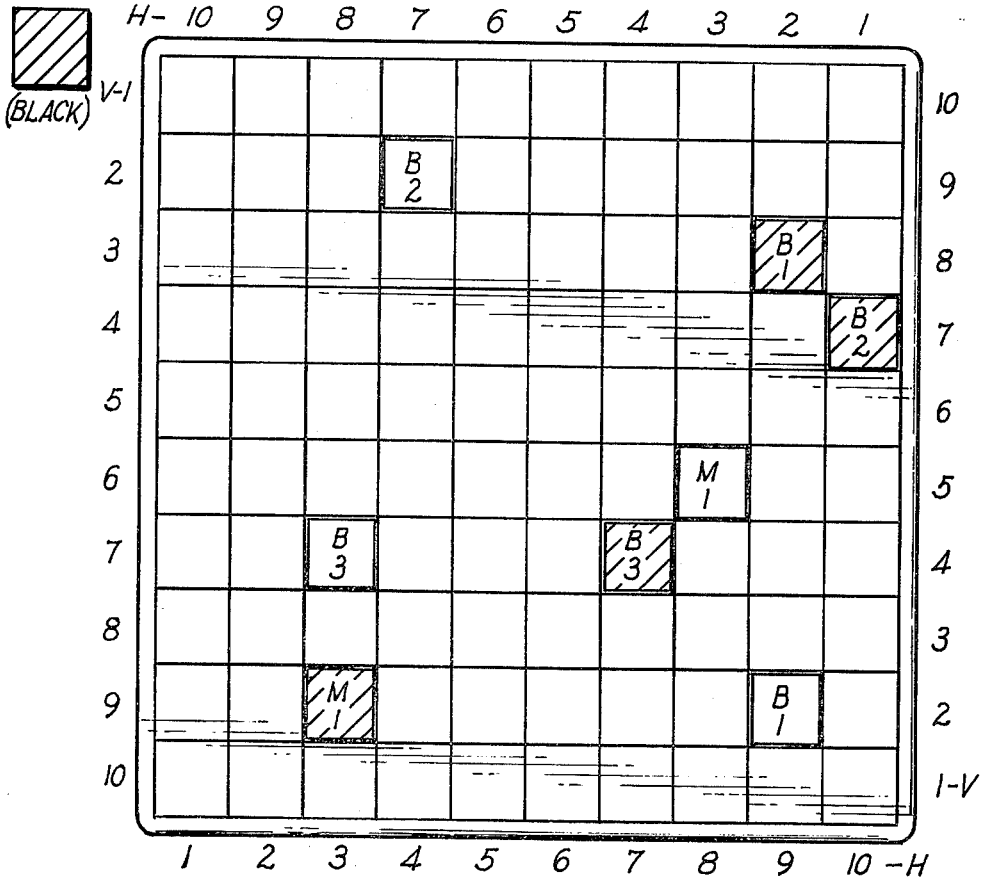
FIG. 2 shows the FIG. 1 gameboard on which the beginning tokens have been placed.
Figure 3:
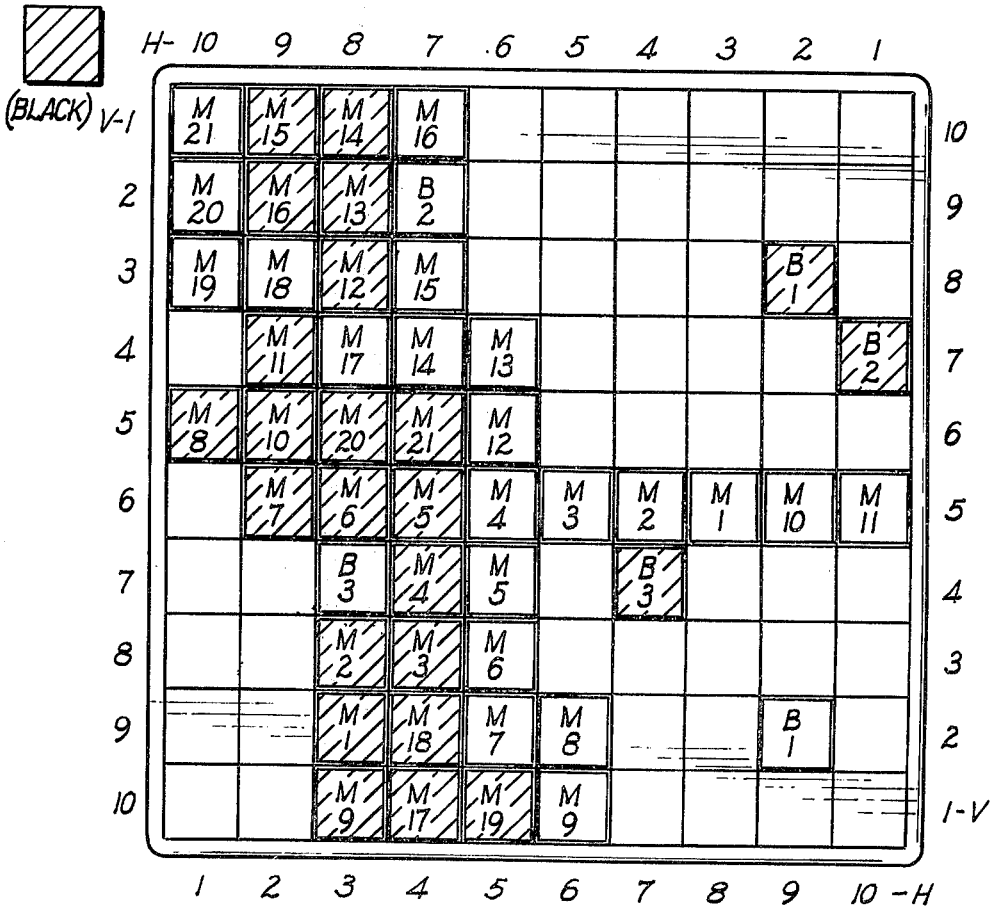
FIG. 3 shows the FIG. 1 gameboard on which the tokens of two players have been placed during an illustrative game.

The board has a plurality of vertical and horizontal rows numbered from one to 10 from left to right and bottom to top as seen by each player. (See FIGS. 2 and 3) The beginning tokens are located as follows. The deck of cards employed in the game is used without queens, kings and jokers. After the deck is shuffled, two cards are turned over for placement of the first starting marker, the number of the first card determines the horizontal row while the number on the second card determines the vertical row. Jacks are wild in placement of the relevant horizontal or vertical row. The players alternate in placement of their beginning pieces with red having the first move until the first marker and three bridges of each player are located in the same manner as described for the first marker. Should the marker of the second player or any of their bridges land on a square already occupied, another second card is dealt. Once the beginning pieces are located the cards are reshuffled and turned over one by one. Whenever a red card is turned over the first player can place a token. Whenever a black card is turned over the second player can place a token. Should a jack be turned over the respective player has an option of moving his bridge one space in any direction to a square not already occupied or placing a marker in the normal manner. In an alternate version of the rules — upon drawing a jack the respective player may move one of his bridges in any direction one square even if it means displacing a marker, but not a bridge, or may place a marker in the normal manner. The players continue to place markers until no further squares can be captured.

As an illustrative example, a game between two players will be described as follows:

The first player's (red) first two cards are an eight and a five respectively. The second player's (black) is an eight and a nine respectively. The next two cards for the red player are a nine and two, for his first bridge; for black a two and three for his first bridge; a four and nine for red's next bridge; an ace and four for black's next bridge; a three and four for red's last bridge; and a four and seven for black's last bridge. As mentioned above the sequence of the respective player's moves is determined by turning over the cards, whenever a black card is turned over it is black's move, whenever a red card is turned over it is red's move.

Red starts from red's original marker at 8,5 and moves into the three adjacent squares in horizontal row 5 and then moving in vertical row 5 moves three squares down. Since red can move in the same direction for only three moves he jogs over to square 6,2 and then completes that portion of the boundary at 6,1. Red completes this enclosure by placing markers at 9,5 and 10,5. It will be noted that in this enclosure red has enclosed not only his bridge B1 but also black's bridge B3.

In the meantime black has started from his original marker at 8,9 and proceeded to place markers moving to 8,8 over to 7,8 down (as seen by black) in vertical row 7 to 7,6 to the right as seen by black in row 6 to 9,6 and thence to 10,5. Black then places a marker at 8,10 to complete that portion of the boundary. In order to prevent red from breaking through his enclosure in a diagonal direction black then places a marker at 9,5. In the enclosure black has enclosed red's bridge B3 but none of his own.

Black then places a market at 9,4 and then moves diagonally to 8,3 attempting to enlarge the enclosure he is working on. Black then moves down in vertical row 8 to 8,1.

Red moves vertically upward in vertical row 5 two places to 5,7 then moves left one space to 4,7 and then upwardly to 3,8. Red's next move is to 4,10 crossing his bridge B2. Red then places his next two markers at 3,7 and 2,8 breaking through black's enclosure before black could perfect it. It will be noted that had black placed a marker at his 9,3 he would have perfected that enclosure. The remaining moves fill in the last few spaces available for play.

In totaling the score first the enclosed bridges are removed and counted — five points for each. Next the squares enclosed and occupied by the respective players are counted, then added to the points resulting from the enclosed bridges to determine the winner of the game.

The game also can be played with three or four players, each player having different colored tokens. In a game for three or four players each player has but a single bridge and each player is given a suit of cards to determine order of play. That is, one player would have hearts, a second clubs and so on. Whenever a heart was turned over the first player would place a marker.

Those versed in the art of games will readily appreciate that the invention achieves the objects and realizes the advantages hereinbefore mentioned.

As many changes could be made in the above constructions without departing from the scope of the invention, it is intended that all matter contained in the above description or shown in the accompanying drawings shall be interpreted as illustrative and not in a limiting sense, and it is also intended that the appended claims shall cover all equivalent variations as come within the true spirit and scope of the invention.

What is claimed is:

1. A game apparatus comprising:

a plurality of first tokens;

a plurality of second tokens visually distinct from said first token;

the first and second plurality of tokens each comprise two classes, the first class being visually distinct from the second class, the classes being markers and bridges;

a playing board having a substantially square playing surface marked into a plurality of smaller squares, said tokens being approximately the same size as the smaller squares of the playing board; and playing cards provided with designations to determine placement of a selected number of the first and second tokens and then to determine the order of play.

2. Game apparatus according to claim 1 in which different colors are used to distinguish the first tokens from the second tokens.

3. Game apparatus according to claim 2 in which the bridges are substantially taller than the markers.

4. Game apparatus according to claim 1 in which both first and second pluralities of tokens include three bridges.

5. Game apparatus according to claim 1 in which a set of beginning tokens include three bridges and one mark for each plurality of tokens, and tokens for continued play include only markers.

6. Game apparatus according to claim 3 further including a plurality of third and a plurality of fourth tokens.

7. Game apparatus according to claim 6 in which the four pluralities of tokens each include only one bridge.

8. Game apparatus according to claim 1 in which the playing cards are 44 in number.

9. Game apparatus according to claim 8 in which a standard deck of playing cards is employed less kings, queens and jokers.

10. Game apparatus according to claim 8 in which the cards comprise four suits of 11 cards each.

11. A game apparatus comprising:

a plurality of first markers and first bridges;

a plurality of second markers and second bridges;

a playing board having a substantially square playing surface marked into a plurality of substantially equal smaller squares;

the markers and bridges each being of a size to occupy most of the area of each of the smaller squares, the bridges being substantially taller than the markers; and playing cards provided with designations to determine placement of the bridges and the first marker of each player and then to determine the order of play.

* * * * *